United States Patent [19]

Johns, Jr. et al.

[11] Patent Number: 4,813,595

[45] Date of Patent: Mar. 21, 1989

[54] MAILBOX FOR RECEIVING DECORATIVE OVERLAYS

[75] Inventors: Benjamin I. Johns, Jr.; Patrick R. Haynes, Jr., both of Bacova, Va.

[73] Assignee: The Bacova Guild, Ltd., Bacova, Va.

[21] Appl. No.: 175,399

[22] Filed: Mar. 30, 1988

[51] Int. Cl.[4] ..... B65D 91/00

[52] U.S. Cl. ..... 232/17; 232/38

[58] Field of Search ..... 232/17, 38

[56] References Cited

U.S. PATENT DOCUMENTS

| | | | |
|---|---|---|---|
| 1,224,234 | 5/1917 | Taber | 232/38 X |
| 2,552,915 | 5/1951 | Zachrich | 232/39 X |
| 3,606,140 | 9/1971 | Shannahan | 232/17 |
| 4,368,842 | 1/1983 | DeLange | 232/17 |
| 4,403,730 | 9/1983 | Batson | 232/39 |
| 4,712,731 | 12/1987 | Gramelspacher | 232/17 |

*Primary Examiner*—Robert W. Gibson, Jr.

*Attorney, Agent, or Firm*—Stevens, Davis, Miller & Mosher

[57] ABSTRACT

A mailbox is disclosed which comprises a housing having flanges located at the bottom, outside periphery thereof and defining holding grooves for peripheral edges of a decorative overlay. Sides of the housing have holes therein which align with corresponding holes of the decorative overlay when the peripheral edges are inserted into the grooves. The decorative overlay is attached to the mailbox by inserting removable fasteners into the aligned holes, thus allowing the overlay to be readily attached to and removed from the housing.

27 Claims, 3 Drawing Sheets

MAILBOX FOR RECEIVING DECORATIVE OVERLAYS

BACKGROUND OF THE INVENTION

1. Field of the Invention

This invention relates to decorative mailboxes, and more particularly, to mailboxes designed to mount readily replaceable, decorative overlays.

2. Discussion of the Prior Art

In the past several years, decorative mailboxes have become increasingly popular. Generally, mailbox decorations can be provided as decorative designs which are painted or stenciled on, or otherwise permanently applied to the mailbox such as by permanently fastening an overlay to the mailbox. A purchaser selects a mailbox having the decorative design which suits his or her fancy. To provide a resonable customer selection of designs requires that a manufacturer produce and a retailer stock a large and cumbersome inventory of mailboxes having the different designs which are available for purchase. From the standpoint of the purchaser, the decorative design of a selected mailbox may go out of style, or the purchaser may simply become tired of the same design. Heretofore, the purchaser has had no opportunity to change the design without replacing the mailbox.

SUMMARY OF THE INVENTION

The present invention is designed to solve the foregoing problems. Accordingly, one object of the invention is to provide a mailbox which is adapted to mountably receive decorative overlays, which are selected and installed, and, if desired, replaced by a purchaser with little effort.

Another object of the invention is to provide a mailbox which can be customized by a purchaser, whenever desired, by permitting the ready mounting and removal of decorative overlays thereon.

Another object of the invention is to reduce the inventory required by a manufacturer and retailer offering decorative mailboxes.

These and other objects, advantages and features of the invention are achieved by providing a mailbox of the usual overall construction, but which includes a pair of grooved holding flanges on the outside lower sidewalls thereof. The flanges are located on the bottom periphery of the sidewalls of the mailbox and are adapted to receive peripheral edges of a flexible decorative overlay so the overlay can be easily mounted on the mailbox with the peripheral edges inserted into the grooved flanges. A purchaser can easily place the decorative overlay on the mailbox by inserting one edge thereof into one of the grooves, wrapping it over the mailbox and then inserting the other peripheral edge into the other grooved flange. The overlay is then secured to the mailbox by removable rivets which are pushed through aligned holes spaced along the lower edge of the overlay and mailbox. Alternatively, the overlay can be formed as a rigid structure having a cross-sectional configuration corresponding to the mailbox in which it is to be mounted. In this instance, peripheral edges of the rigid structure are placed into the grooved flanges of the mailbox with substantially little bending or flexing of the overlay and the overlay is again fixed to the mailbox by means of removable rivets which pass through aligned holes in the overlay and mailbox.

The present invention thereby offers an economically feasible way to have interchangeable decorative overlays for a purchaser's mailbox, without requiring a manufacturer or retailer to stock a large number of predesigned mailboxes. Instead only one type of mailbox need be manufactured and offered for sale together with a plurality of different types of decorative overlays from which a purchaser can select at the retail level.

The above and other objects, advantages and features of the invention will be more readily understood from the following detailed description of the invention which is provided in connection with the accompanying drawings.

DESCRIPTION OF THE PREFERRED EMBODIMENT

Figure 1:
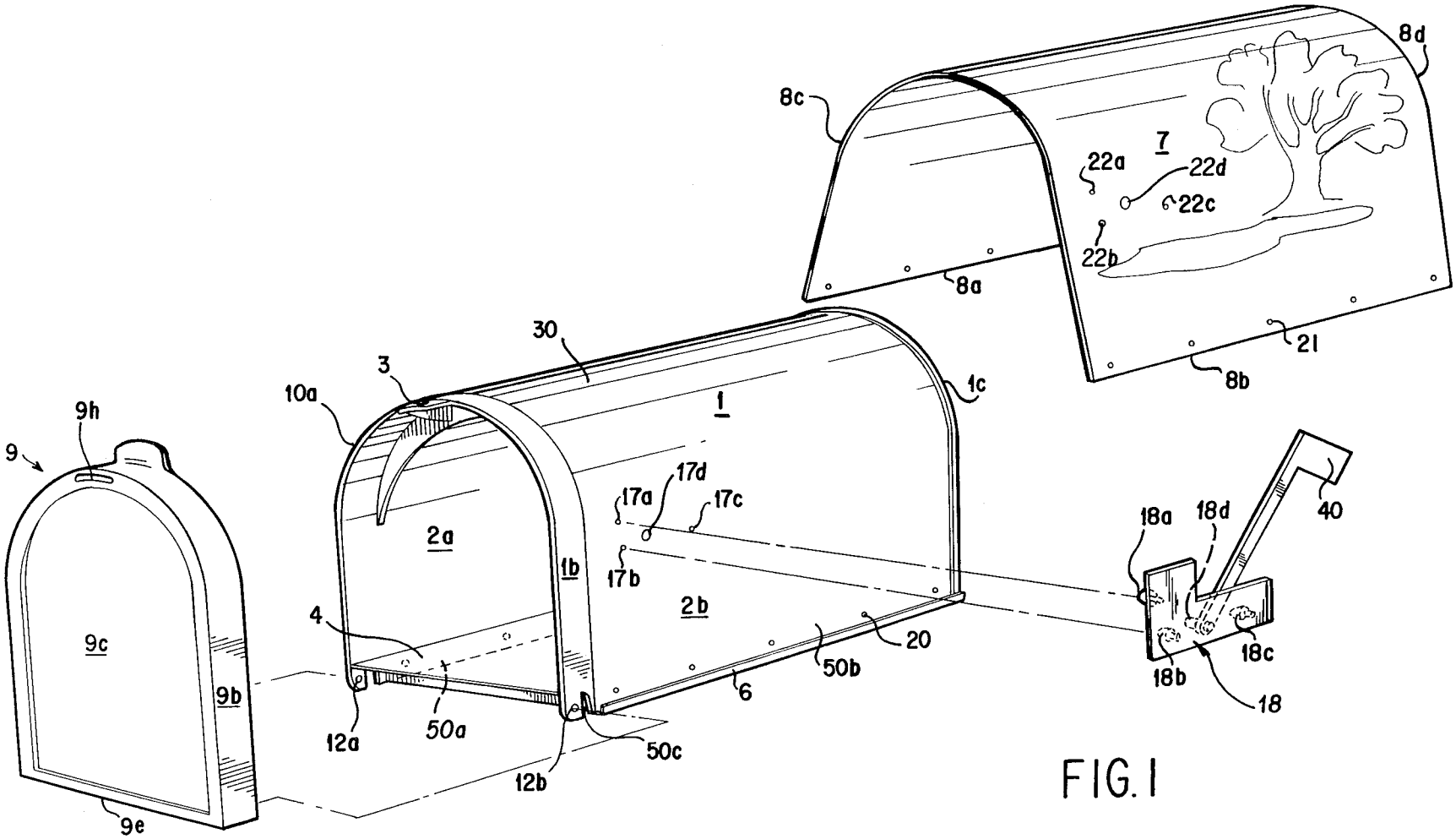
FIG. 1 is a perspective view of a mailbox of the invention and an associated replaceable decorative overlay.

As shown in FIG. 1, the mailbox of the invention has the usual overall shape of a rural mailbox, that is, a mailbox having an overall inverted U cross-sectional shape. It includes a rounded cavernous main body 1, which is open on one end 10*a*, and closed on the other, a planar floor 4, and sidewalls forming body 1 which are perpendicular to the floor. Two of the sidewalls, 2*a* and 2*b*, are generally parallel to one another and merge at the rounded upper portion 30 of body 1, while a third end sidewall 32 forms the closed end of the body 1. One of the sidewalls, e.g., 2*b*, has holes 17*a*, 17*b*, 17*c* and 17*d*. Holes 17*a*, 17*b* and 17*c* respectively receive mounting rivets 18*a*, 18*b* and 18*c* of a flag mounting element 18 which is described below. Hole 17*d* receives a projection 18*d* of element 18 which is integrally molded, the projection serving as an axle for a flag staff. At the apex of the inverted U, adjacent open end 10*a* is an apertured tab 3 which extends outward for insertion into an aperture 9*h* provided in a door 9. The tab 3 enables the door 9 to be locked with conventional lock devices.

A slightly raised portion 1*b* of body 1 extends around the periphery of open end 10*a* and from open end 10*a* towards the closed end of body 1 to form a continuous inverted U-shaped band which embraces the entire opening periphery. At the closed end of body 1 is another, narrower, raised portion 1*c*, which forms another continuous inverted U-shaped band.

A flange 6 is located on the bottom and along the side periphery of each parallel sidewall 2*a*, 2*b*. The sidewalls 2*a* and 2*b* have respective lower sections 50*a* and 50*b*, which extend below a horizontal plane embracing floor 4. The flanges 6 extend outwardly from the bottom periphery of lower sections 50*a* and 50*b* and along the entire length of the mailbox and form overlay holding grooves. In addition, the lower sections 50*a*, 50*b* have a series of holes 20 spaced along their longitudinal extent, as shown in FIG. 1. Each lower section 50*a*, 50*b* also has a slot 50*c* located below the intersection of each parallel wall and floor 4 to permit the mailbox door 9 to swing downwardly. Adjacent to the slots are respective hole 12*a*, 1*b* for receiving pivots for rotational mounting of the door 9.

Figure 3:
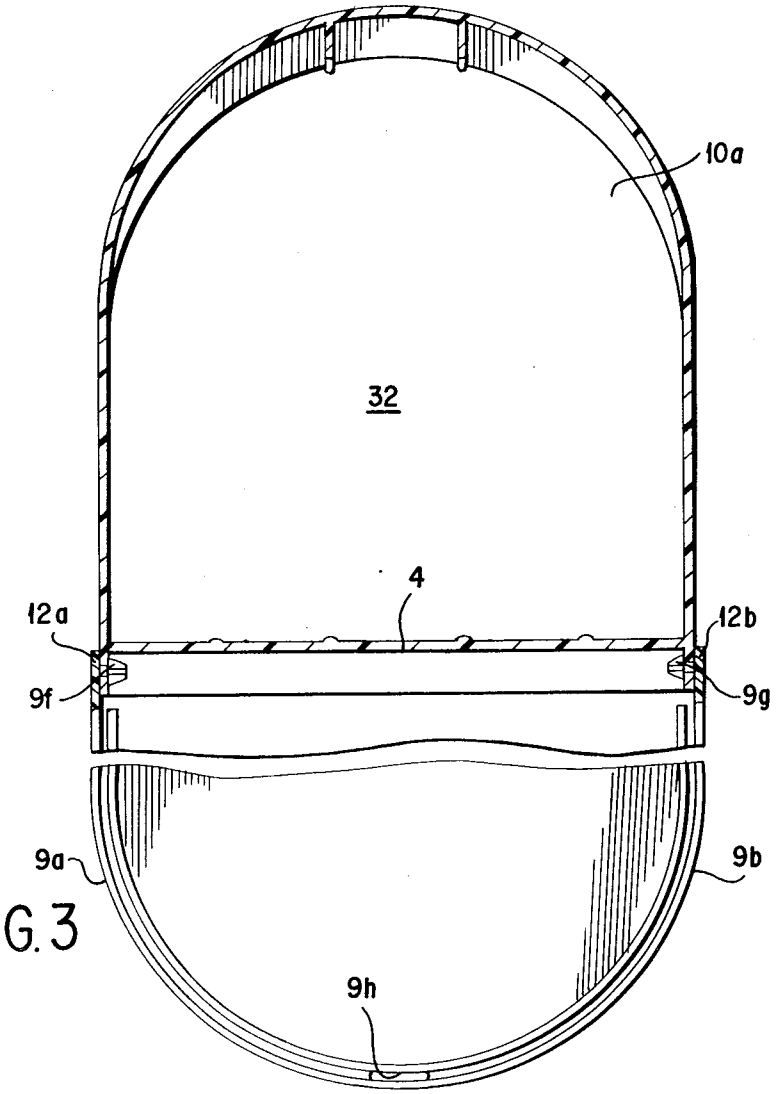
FIG. 3 is an end view of the mailbox with the door in its open position.

As shown in FIGS. 1 and 3, the door 9 contains sidewalls 9*a* and 9*b*, and a front wall 9*c*. The door 9 is configured so that it covers the open end 10*a* of body 1, and each of the sidewalls 9*a*, 9*b* of the door has a respective integrally molded, inwardly extending pivot hinge 9*f*, 9*g* located near the bottom of the door. The pivot hinges 9*f*, 9*g* project inwardly so that door 9 can be mounted over open end 10*a*, with the pivot hinges entering into respective holes 12*a*, 12*b*. Preferably the door 9 and body 1 are made of a generally rigid plastic which has some flexibility to permit the sidewalls 9*a*, 9*b* of the door to be pulled apart slightly to allow the hinges 9*f*, 9*g* to enter holes 12*a*, 12*b* during assembly. At the apex of the door 9 is located the elongated aperture 9*h* which is adapted to receive apertured tab 3. As noted, when door 9 is in its closed position, tab 3 extends through the aperture 9*h*, thus allowing the door to be locked.

The mailbox body 1, including sidewalls 2*a*, 2*b*, the rear wall 32, floor 4, the lower sections 50*a* and 50*b* and the flanges 6, is preferably formed as a one-piece integral molding. Likewise, door 9, including hinges 9*f* and 9*g*, is preferably formed as a one-piece integral molding, both the door 9 and body 1 preferably being made of a molded polypropylene, or other known moldable plastic, having a small degree of flexibility.

The mailbox of the invention is particularly adapted to be used with removable decorative ioverlays, one of which is shown in the drawings as 7. One embodiment of the decorative overlay is formed as a flexible sheet which has received a decorative design. These sheets can be formed of an acrylic, fiber glass or a polycarbonate. These designs are applied to a planar surface of the overlay sheet by silk screening, sublimation, heat transfer or the like. As shown in FIG. 1, overlay 7 has a pair of lower edges 8*a*, 8*b* along which two series of holes 21 are respectively and laterally arranged. The overlay also has holes 22*a*, 22*b*, 22*c* and 22*d* which align with holes 17*a*, 17*b*, 17*c* and 17*d* of body 1 to allow the mounting of a flag support element 18 and the insertion of projection 18*d*, described below.

Figure 2:
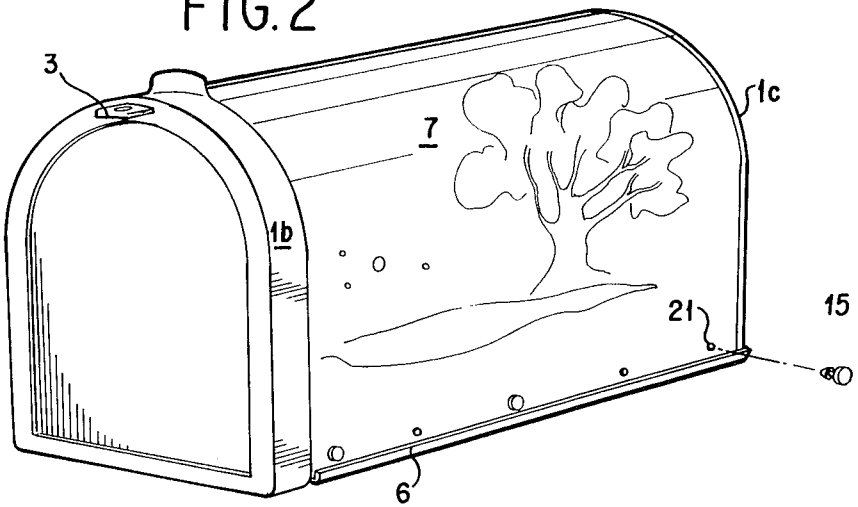
FIG. 2 is a perspective view of the mailbox in FIG. 1 with the decorative overlay in place.

The manner in which the above-described flexible decorative overlay 7 is mounted and attached to mailbox body 1 will now be described with particular reference to FIGS. 1, 2, 4 and 5. A purchaser purchases the mailbox, including body 1 and associated door 9, together with a desired decorative overlay 7. One peripheral edge, e.g., 8*b*, of the overlay is then inserted into a groove formed by a flange 6 on a sidewall, e.g., sidewall 2*b*, as shown in FIG. 5, and the overlay 7 is wrapped over the mailbox and the other peripheral edge thereof inserted into the groove formed by the other flange 6. Side edges 8*c* and 8*d* of the overlay are aligned to abut raised portions 1*b* and 1*c* so that the overlay is held in place on the body 1 by the grooved flanges 6 between raised portions 1*b* and 1*c*. The fitting of the overlay between raised portions 1*b* and 1*c* causes the overlay holes 21 to align with corresponding holes on body 1. As shown by FIG. 2, the overlay is then fixed in place on sidewalls 2*a* and 2*b* by inserting removable snap-in rivets 15 of the type shown in FIG. 4 through the aligned holes 20, 21 respectively provided in body 1 and overlay 7 on both sides of the mailbox. Preferably, as shown in FIG. 2, two of the aligned holes 20, 21 on each side of the mailbox do not receive rivets so as to provide apertures which enable the mounting of the mailbox on a post.

Figure 4:
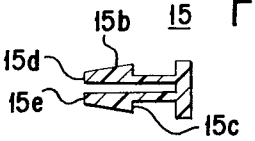
FIG. 4 is a side view of a removable fastener for fastening the decorative overlay to the mailbox.
Figure 5:
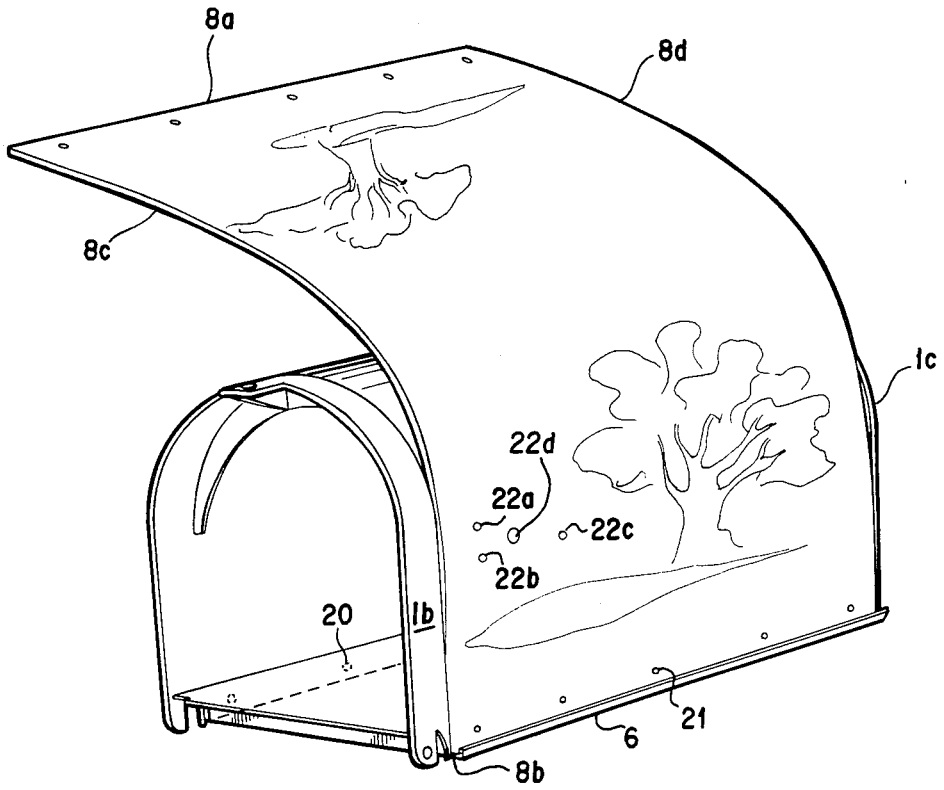
FIG. 5 is a perspective view of the mailbox showing one manner in which the decorative overlay is mounted thereon.

As shown by FIG. 4, the snap-in rivet 15 has a tapered insertion end 15*b* which facilitates insertion of the rivet into a hole. The insertion end 15*b* comprises a radially expandable portion having a locking edge 15*c* which engages with the periphery of a hole once inserted therein and prongs 15*d*, 15*e* which are spaced apart so that they can be squeezed together to reduce the diameter of the insertion end 15*b* during an insertion operation. After the locking edge 15*c* clears the holes, the prongs 15*d*, 15*e* expand (snap back) to their original spacing to secure the snap rivets in the holes, thereby locking overlay 7 in place on the body 1.

Of course, the snap-in rivets 15 may first be inserted through the holes 20 and 21 on one side of the mailbox before overlay 7 is wrapped therearound, after which snap-in rivets are inserted through aligned holes on the opposite side of the mailbox.

In a second embodiment, the decorative overlay may be formed to possess a substantially rigid, inverted U shaped cross section, as shown in FIG. 1. This structure alleviates the need to substantially flex and wrap the overlay before inserting the overlay's edges 8*a*, 8*b* into the flanges 6. Instead, the rigid overlay is merely positioned over the mailbox body 1 with its lower peripheral edges entering into the grooves defined by flanges 6 and with its side edges positioned between raised portions 1*b* and 1*c*. Subsequently, the rivets 15 are inserted through aligned holes in the overlay and mailbox.

For mounting door 9 on the body 1, resilient sidewalls 9*a*, 9*b* near the integral hinges 9*f* and 9*g* are pulled outwardly so that hinges 9*f*, 9*g* can be inserted into holes 12*a* and 12*b*. When the sidewalls 9*a*, 9*b* return to their original position, the hinges 9*f* and 9*g* are driven through holes 12*a*, 12*b*, and door 9 is held in place and pivotable about the hinges for opening and closing. When door 9 is opened, slots 50*c* receive edge 9*c* and allow the door to have a pivot range from a closed position to an open position of about 0° to 180° with respect to the open end 10*a*.

As shown in FIG. 1, a flag 40 is affixed to the mailbox by means of a flag support element 18. Rivets 18*a*, 18*b* and 18*c* and the axle projection 18*d*, which are integrally formed onto the back surface of the support element 18, are respectively aligned with the holes 17*a*, 17*b*, 17*c* and 17*d* of the mailbox body 1 and corresponding holes 22*a*, 22*b*, 22*c* and 22*d* of the overlay 7. The rivets 18*a*, 18*b*, 18*c* are then inserted through the holes 22*a* and 17*a*, 22*b* and 17*b* and 22*c* and 17*c* respectively, thereby attaching the flag support 18 to the mailbox body 1. Likewise, the end of the axle projection 18*d* fits into apertures 17*d*, 22*d* so that the end of the projection is flush with the inside surface of sidewall 2*b*. Flag 40 is pivotably mounted on the axle before insertion of the axle into holes 17*d*, 22*d* so that the flag has the usual 90° pivot range once the support element 18 has been mounted.

For removal of the overlay 7, the flagged staff is first removed from the body 1 by removing the integral rivets 18*a*, 18*b*, 18*c* which hold the flag support 18 in place. As a result, projection 18*d* is also removed from holes 17*d* and 22*d*. Then the remaining rivets 15 holding the overlay 7 to the mailbox 1 are removed. All rivets are removed by squeezing together prongs 15*d* and 15*e* and pushing them back through the holes in which they were inserted. Once all the rivets have been removed, overlay 7 can be removed from grooved flanges 6, and another overlay can be inserted and attached to the mailbox assembly as described above.

While a specific embodiment of the invention has been described and illustrated, it should be apparent that many modifications can be made thereto without departing from the spirit and scope of the invention. For example, although the grooves formed by flanges 6 run substantially the entire length of mailbox body 1, a plurality of spaced flanges 6 can be formed along each lower edge of the body 1 to thereby form a plurality of aligned, spaced grooves running from the front to the back of each lower edge of the mailbox.Accordingly, the invention is not limited by the foregoing description, but is only limited by the scope of the appended claims.

We claim:

1. A mailbox comprising:

a housing having a bottom, sides, an endwall at one end thereof and an opening at another end thereof;

at least one flange provided on the exterior of a lower portion of each said sides of said housing, each flange having an upturned portion defining a respective upwardly opening holding groove adapted to receive a respective peripheral edge of a decorative overlay; and a door adapted to be pivotably connected to said housing for closing said opening.

2. A mailbox as in claim 1, further comprising a plurality of holes provided in and spaced along said lower portion of each of said sides for receiving fasteners for holding a decorative overlay on said housing.

3. A mailbox as in claim 2, wherein said holes are positioned below a horizontal plane which contains said bottom, said holes being linearly spaced from said opening to said endwall.

4. A mailbox as in claim 1, wherein said housing further comprises a pair of door mounting pivot holes and wherein said door includes a pair of sidewalls having inwardly directed integral hinges, said hinges being adapted to engage said door mounting pivot holes so that said door is mountable on said housing and movable to open and close said opening.

5. A mailbox as in claim 4, wherein said mounted door has a 180° range of movement from an open position to a closed position with respect to the opening of said housing.

6. A mailbox as in claim 1, wherein said flanges extend from said opening to said endwall on each side of said housing.

7. A mailbox as in claim 1, wherein said housing and flanges are an integrally molded assembly.

8. A mailbox as in claim 1, further comprising a first raised portion provided adjacent at least a portion of a periphery of said endwall for aligning one edge of said overlay.

9. A mailbox as in claim 8, further comprising a second raised portion provided adjacent at least a periphery of said opening for aligning another edge of said overlay.

10. A mailbox as in claim 1, wherein a plurality of spaced flanges are provided on a lower portion of each of said sides of said housing, each of said flanges defining a respective holding groove adapted to receive a portion of a peripheral edge of a decorative overlay.

11. A mailbox comprising:

a housing having a bottom, sides, an endwall at one end thereof and an opening at another end thereof;

at least one flange provided on the exterior of a lower portion of said sides of said housing, each flange having an upturned portion and defining a respective holding groove adapted to receive a peripheral edge of a decorative overlay;

a decorative overlay mounted to cover at least the sides of said housing, said overlay having peripheral edges respectively engaged in said holding grooves; and, a door pivotably connected to said housing for closing said opening.

12. A mailbox as in claim 11, further comprising a plurality of holes provided in and spaced along said lower portion of each of said sides, a plurality of holes provided in said decorative overlay and aligned with said holes in said sides, and a plurality of removable fasteners respectively engaged in said aligned holes for removably holding said decorative overlay on said housing.

13. A mailbox as in claim 12, wherein said holes provided in said lower portions of said sides are positioned below a horizontal plane which contains said bottom, said holes being linearly spaced from said opening to said endwall.

14. A mailbox as in claim 11, wherein said flanges extend from said opening to said endwall on each side of said housing.

15. A mailbox as in claim 11, further comprising a first raised portion provided adjacent at least a portion of a periphery of said endwall for aligning one edge of said overlay.

16. A mailbox as in claim 15, further comprising a second raised portion provided adjacent at least a periphery of said opening for aligning another edge of said overlay.

17. A mailbox as in claim 11, wherein said decorative overlay is generally rigid and has a shape conforming to that of said housing, said peripheral edges of said overlay being inserted into said holding grooves with substantially little manipulative bending of the overlay.

18. A mailbox as in claim 17, further comprising a plurality of holes provided in and spaced along said lower portion of each of said sides, a plurality of holes provided in said decorative overlay and aligned with said holes in said sides, and a plurality of removable fasteners respectively engaged in said aligned holes for removably holding said generally rigid decorative overlay on said housing.

19. A mailbox comprising:

a housing having at least a bottom, a closable opening and sidewalls extending upwardly from said bottom;

means for holding a decorative overlay on the exterior of said housing, said holding means being provided along at least a portion of a lower part of at least one of said sidewalls and being engageable with a peripheral edge of a decorative overlay; and a door pivotably connected to said housing for closing said opening.

20. A decorative overlay adapted for mounting on a mailbox, said mailbox comprising a housing having a bottom, sides, and endwall at one end thereof and an opening at other end thereof, the sides of said housing having apertures therein for receiving fasteners; at least one flange provided on the exterior of a lower portion of each of said sides of said housing, each flange having an upturned portion defining a respective upwardly opening holding groove; and, a door pivotably connected to said housing for closing said opening, said decorative overlay comprising:

a planar flexible sheet having a visible design thereon and four peripheral edges, said sheet having a shape, size and flexibility which allows it to be mounted on said mailbox such that two of said peripheral edges on opposite sides of said sheet are received in and held by respective ones of said holding grooves of said mailbox, said sheet including a plurality of pre-established apertures therein which are positioned to align with corresponding apertures provided in said housing to allow the fastening of said overlay on said mailbox by the passage of a fastener through aligned apertures of said overlay and housing.

21. A decorative overlay adapted for mounting on a mailbox, said mailbox comprising a housing having a bottom, sides, and endwall at one end thereof and an opening at other end thereof, the sides of said housing having apertures therein for receiving fasteners; at least one flange provided on the exterior of a lower portion of each of said sides of said housing, each flange having an upturned portion defining a respective upwardly opening holding groove; and, a door pivotably connected to said housing for closing said opening, said decorative overlay comprising:

a generally rigid sheet having a visible design thereon and four peripheral edges, said sheet having a shape and size conforming to a shape and size of said housing which allows said sheet to be mounted on said mailbox with substantially little manipulative bending such that two of said peripheral edges on opposite sides of said sheet are received in respective ones of said holding grooves of said mailbox, said sheet including a plurality of pre-established apertures therein which are positioned to align with corresponding apertures provided in said housing to allow the fastening of said overlay on said mailbox by the passage of a fastener through aligned apertures of said overlay and housing.

22. A decorative overlay as in claim 20 wherein a first plurality of said pre-established apertures of said overlay are located along and adjacent said two peripheral edges thereof for alignment with apertures of said mailbox housing provided along a lower edge of each of the sides of said housing.

23. A decorative overlay as in claim 21 wherein a first plurality of said pre-established apertures of said overlay are located along and adjacent said two peripheral edges thereof for alignment with apertures of said mailbox housing provided along a lower edge of each of the sides of said housing.

24. A decorative overlay as in claim 22 wherein a second plurality of said pre-established apertures of said overlay are located away from said two peripheral edges for alignment with apertures of said mailbox housing provided on a side of said housing.

25. A decorative overlay as in claim 23 wherein a second plurality of said pre-established apertures of said overlay are located away from said two peripheral edges for alignment with apertures of said mailbox housing provided on a side of said housing.

26. A decorative overlay as in claim 20 wherein said sheet has a size such that the remaining two peripheral edges are received on said housing between a first raised portion of said housing provided adjacent at least a portion of a periphery of said endwall and a second raised portion of said housing provided adjacent at least a periphery of said opening.

27. A decorative overlay as in claim 21 wherein said sheet has a size such that the remaining two peripheral edges are received on said housing between a first raised portion of said housing provided adjacent at least a portion of a periphery of said endwall and a second raised portion of said housing provided adjacent at least a periphery of said opening.

* * * * *